US008884163B2

(12) United States Patent
Chu et al.

(10) Patent No.: US 8,884,163 B2
(45) Date of Patent: Nov. 11, 2014

(54) SKIN CURED PTFE WIRE AND CABLE

(75) Inventors: Wayne Y. Chu, Wilson, NC (US); Jun Hong Yi, Wilson, NC (US)

(73) Assignee: Nexans, Paris (FR)

( * ) Notice: Subject to any disclaimer, the term of this patent is extended or adjusted under 35 U.S.C. 154(b) by 811 days.

(21) Appl. No.: 12/434,817

(22) Filed: May 4, 2009

(65) Prior Publication Data

US 2009/0294151 A1 Dec. 3, 2009

Related U.S. Application Data

(60) Provisional application No. 61/127,554, filed on May 14, 2008.

(51) Int. Cl.

| | |
|---|---|
| ***H01B 7/295*** | (2006.01) |
| ***H01B 13/14*** | (2006.01) |
| *H01B 7/02* | (2006.01) |

(52) U.S. Cl.

CPC ..... *H01B 13/14* (2013.01); *H01B 7/0291* (2013.01)

USPC ..... 174/120 R

(58) Field of Classification Search

USPC ..... 174/120 R

See application file for complete search history.

(56) References Cited

U.S. PATENT DOCUMENTS

| | | | | |
|---|---|---|---|---|
| 5,220,133 | A * | 6/1993 | Sutherland et al. | 174/120 R |
| 5,414,215 | A * | 5/1995 | Dunand et al. | 174/113 R |
| 5,426,264 | A * | 6/1995 | Livingston et al. | 174/102 R |
| 6,780,360 | B2 * | 8/2004 | Lange et al. | 264/127 |

FOREIGN PATENT DOCUMENTS

| | | |
|---|---|---|
| CA | 1151255 | 8/1983 |
| WO | 2006005426 | 1/2006 |

OTHER PUBLICATIONS

PCT notification of transmittal of international search report and the written opinion of the international searching authority, or the declaration, dated Jan. 2010.

* cited by examiner

*Primary Examiner* — Chau N Nguyen

(74) *Attorney, Agent, or Firm* — Sofer & Haroun, LLP

(57) ABSTRACT

A wire having a conductor and an insulation where the insulation has a first inner layer of an uncured material and a second outer layer of a cured material.

19 Claims, 7 Drawing Sheets

SKIN CURED PTFE WIRE AND CABLE

RELATED APPLICATION

This application claims the benefit of priority from U.S. provisional patent application No. 61/127,554, filed on May 14, 2008, the entirety of which is incorporated by reference.

BACKGROUND

1. Field of the Invention

This application relates to signal wires. More particularly, this application relates to insulation for signal wires.

2. Description of Related Art

PTFE (poly(tetrafluoroethene) or (poly(tetrafluoroethylene)) is one of the leading base dielectric materials used for insulation for high speed data cables because of PTFE's excellent dielectric constant, low dissipation factors, temperature performance range, and frequency stabilities. In addition, PTFE is unique as its dielectric constant depends on the degree of sintering (formation/curing).

Many cable designers have leveraged the low dielectric constant (about 1.6) of raw PTFE tape and extruded PTFE (w/o sintering) to produce high performance data cables. The industry has also generated an 'expanded' or 'ePTFE' technology to further reduce the dielectric constant. ePTFE is constructed by stretching unsintered PTFE to provide increased volume of PTFE. For example, cable designers and processors apply and use expanded PTFE both in taped PTFE and extruded PTFE applications as a dielectric to create superior high speed data cables. Many products use the combination of both raw PTFE (and expanded PTFE) to achieve very low dielectric constant, thus achieving high velocity propagation.

However, the dimension stability and performance stability of uncured and expanded PTFE tape construction is poor. For example, expanded PTFE suffers from very short use-life in coaxial cables and data bus cables due to the tendancy for short circuits between the center conductor and the braiding material. Such failures are often related to dynamic applications such as constant bending, vibration, and tight pinching. Like ePTFE, extruded raw PTFE dielectric in such applications also tends to crack after a few bending cycles, which also leads to the same failure mode.

SUMMARY OF THE INVENTION

In one arrangement a 'skin cured' PTFE is provided that allows for the utilization of the low dielectric constant of the raw PTFE which is resistant to cracking (raw PTFE core), and has good dimensional and performance stability. The skin layer of the PTFE, which is cured, forms an outer layer, farthest from the conductor while the remainder of the PTFE nearer to the conductor remains uncured. Together the combined PTFE insulation provides mechanical integrity with lasting electrical performance and use-life. This form of skin cured PTFE may be used for both extruded PTFE and extruded expanded PTFE dielectric insulations.

The present arrangement further allows the better servicing of the aerospace market by using lower dielectric constant material (raw PTFE) to achieve smaller size and lightweight coaxial, data bus, and Ethernet cables without sacrificing the mechanical performance of fully cured (sintered) PTFE dielectric material.

BRIEF DESCRIPTION OF THE DRAWINGS

The present invention can be best understood through the following description and accompanying drawings, wherein.

DETAILED DESCRIPTION

Figure 1:
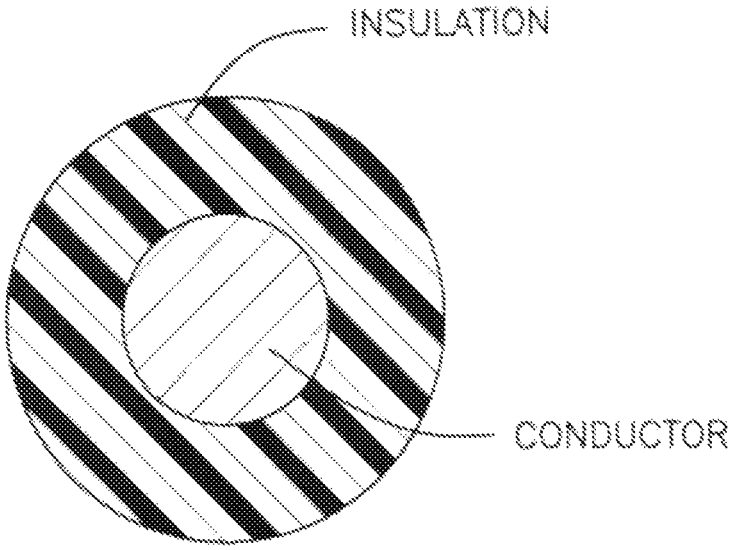
FIG. 1 (PRIOR ART)
FIG. 1 shows a conductor with a single layer of dielectric insulation according to the prior art.

Raw PTFE has a dielectric constant of about 1.6, after fully sintering (curing), ts dielectric changes to 2.1. Sintering is performed on PTFE material in order to provide it with mechanical strength and prevent cracking. FIG. 1 shows a prior art wire, such as signal conductor, with a single layer of either sintered or unsintered PTFE surrounding a conductor. As noted in above, when unsintered, PTFE has a dielectric constant of approximately 1.6, but it has poor mechanical characteristics. When sintered, its mechanical properties are increased but its dielectric constant is reduced in effectiveness to approximately 2.1

Figure 2:
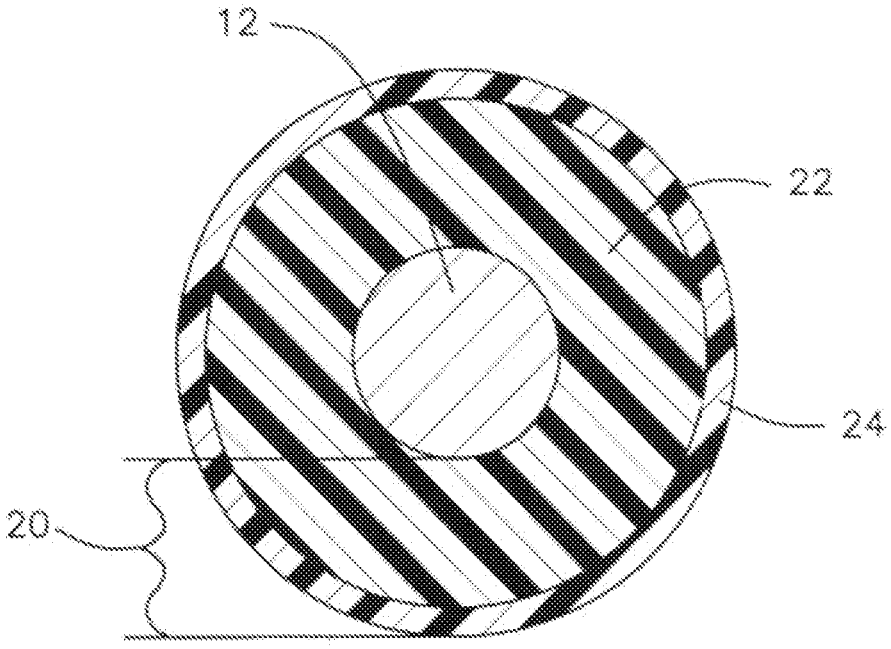
FIG. 2 shows a conductor with a dual layer, skin cured dielectric insulation according to one embodiment of the present invention.

In one embodiment, as shown in FIG. 2, a wire or cable 10 is shown having a conductor 12 and a dual layer insulation 20, where the inner layer 22 is unsintered raw PTFE and the outer layer 24 is cured or sintered.

Such an arrangement, when applied to an extruded raw PTFE dielectric, achieves dielectric constant of about 1.6 to 2.1 depending on the relative thicknesses of inner and outer layers 22 and 24. As noted above, in general, the lower the dielectric constant, the better the performance of the cable (such as electrical, lighter and smaller the cable, better flexibility).

In one preferred arrangement, cured outer skin layer 24 is produced to a thickness of between 0.01 mil ($1000^{th}$ of an inch) to 20 mil thickness. In a another preferred arrangement the thickness of outer skin layer 24 is set between 0.5 mils and 5.0 mil.

In another example, 10 Ghz coaxial cable, may be fitted with the above described arrangement such that it maintains an outer skin layer 24 with a 2.0 mil thickness over the uncured inner layer 22.

For example, Mil-C-17/128 (RG400) is one popular coaxial cable used in military applications. The regular RG400 uses fully sintered Solid PTFE as dielectric. According to the present arrangement, the construction may use the inner outer layer 22/24 configuration as described above with the thickness of outer layer 24 being 2.0 mils. The following Table 1 is a comparison of the prior art arrangement versus the present arrangement showing improved flexibility, size and weight while simulataneously showing improved velocity propagation (reciprocal of the square root of the dielectric constant of the material through which the signal passes).

TABLE 1

| Key Performance | Regular RG400 | Raw/Skin RG400 |
|---|---|---|
| Dielectric | Solid PTFE 100% Sintered | Raw PTFE with 2 mil Sintered Skin |
| Condcutor OD (inch) | 0.0384" | 0.0384" |
| Core Core (50 ohm) | 0.120" | 0.109" |
| Velocity Propagation | 69.80% | 76.20% |
| 1st Braid (95%, 36 awg) | 0.142" | 0.131" |
| 2nd Braid (95%, 36 awg) | 0.164" | 0.153" |
| Jacket (FEP, 15 mil wall) | 0.194" | 0.183" |
| Saving in Size (%) | | 5.60% |
| Saving in Weight (lb/kft) | | 15.1% |
| Additional Benefit: | Rigid | Flexibility |

It is noted that the above examples of the skin cured layer 24 and inner insulation layer 22, and their relative thicknesses are intended to be exemplary. It is understood that any such skin cured insulation having a inner unsintered layer and an outer sintered layer is within the contemplation of the present invention.

The above described arrangement achieves desirable mechanical properties (based on skin cured outer layer 24 while maintaining lower overall dielectric constant, by leveraging the low dielectric constant of raw PTFE in the inner layer 22. Thus, the PTFE dielectric of inner layer 22, which is cured (sintered) partially to achieve a precision skin layer 24, serves as a tough layer, to provide the remaining inner layer 22 with a satisfactory protection and improved mechanical characteristics, such as, but not limited to, cracking resistance, abrasion resistance, fibrous disintegration resistance, and pin-through resistance. Cured (sintered) PTFE skin layer 24 is thin relative to inner layer 22 thus providing insulation 20 with overall low dielectric constant close to the level of raw PTFE dielectric.

Moreover, skin cured insulation 20 is also a cost reduction measure, for hookup wires and other such wires where the dielectric constant, dissipation factor is not critical. Because the specific gravity of Raw PTFE is about 30% lower than that of the sintered PTFE there is less overall material usage (raw PTFE has density of 1.6 g/cc while the sintered PTFE has 2.16 g/cc.)

The formation of outer skin layer 24 from inner layer 22 in insulation 20 may be achieved by partially curing inner layer 22. Thus, inner layer 22 is typically extruded onto conductor 10 and then by partial curing, described below, outer layer 24 is formed directly from the uncured inner PTFE. This curing of skin layer 24 may be performed using a regular radiant or convection oven, an IR oven, LASER curing or a Contact heating source, such as salt bath.

In one exemplary method, outer skin layer 24 curing is achieved with a controlled thermal oven (convection, radiate, or IR, etc) that is applied after extrusion of inner layer 22 onto conductor 20. In another example, laser or IR beam curing may be used, which provides added control over the relative thickness of skin layer 24.

It is noted that, as outer skin layer 24 is cured a gradient may form between inner and outer layers 22/24. For example, the curing process using a thermal oven may cause a partially cured gradient between inner layer 22 and outer layer 24. The depth of the gradient depends on the heating and cooling history during the sintering process. In one example, if only sufficient heat energy for curing 2 mil of PTFE (to form outer layer 24) is provided, the gradient is likely to be small. Using IR energy source for curing outer layer 24, an even thinner gradient may be achieved.

Figure 3:
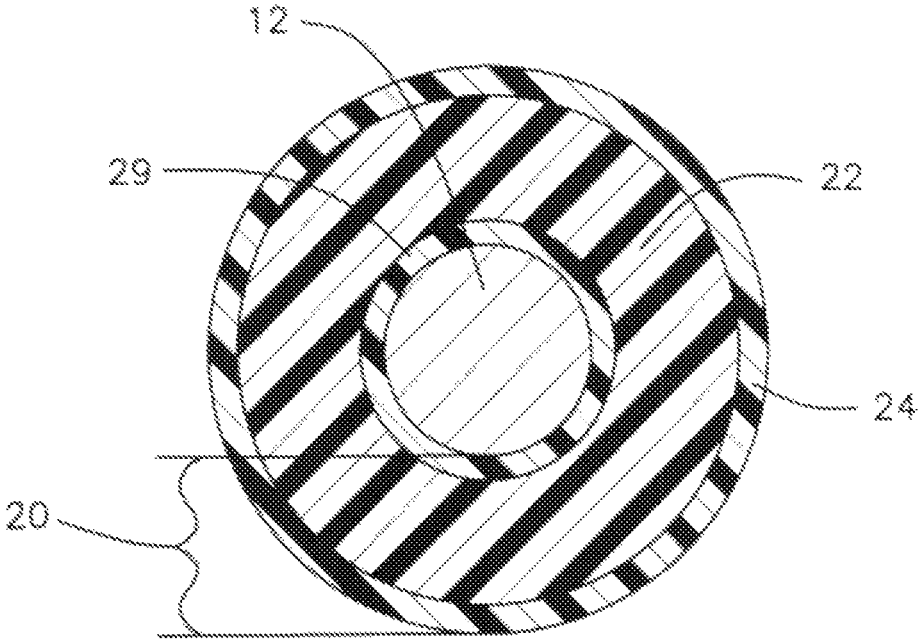
FIG. 3 shows a conductor with a dual layer, skin cured dielectric insulation having a third conductor coating layer of cured, according to another embodiment of the present invention.

In another embodiment, as shown in FIG. 3, in addition to partially curing an outer layer 24 of insulation 20, it is possible to also partially cure inner layer 22 using an induction heater or direct heating the conductor 12 forming a conductor coating insulation layer 29. Such an arrangement provides an additional layer of mechanical strength on the inside of inner layer 22 directly against conductor 12, while still maintaining the majority of insulation layer 20 as uncured PTFE This skin curing technology of the present invention may further be used to take advantage of low dielectric constant of raw PTFE and the expanded PTFE in the extruded construction. This arrangement also provides a design for the PTFE expanded tape construction with introduction of cured (sintered) solid skin layer or cure the expanded skin layer directly to the overall PTFE expanded tape construction to provide sufficient pin-through resistance.

Figure 4:
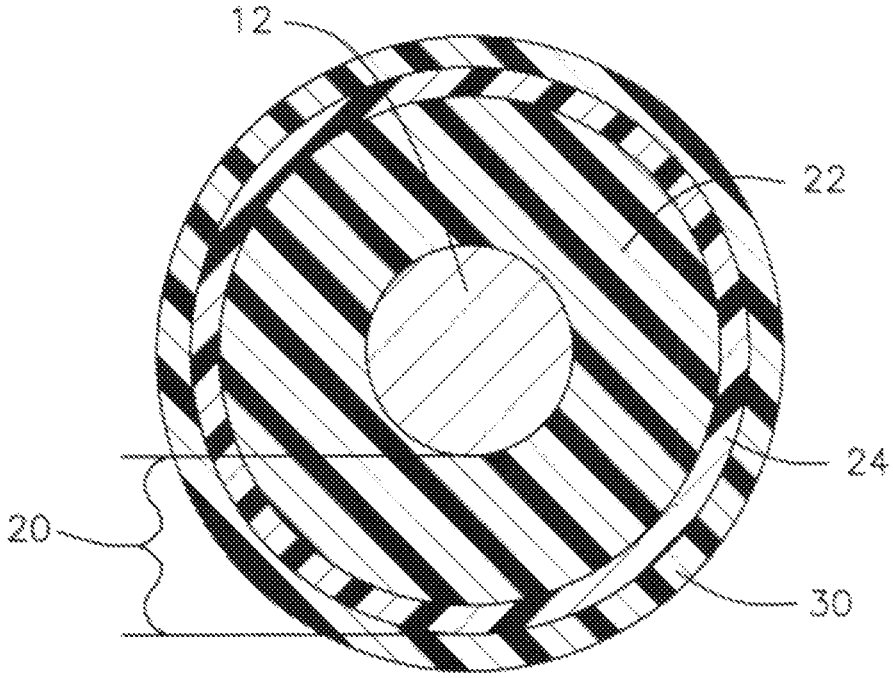
FIG. 4 shows a conductor with a dual layer, skin cured dielectric insulation according to another embodiment of the present invention.

In another arrangement, as shown in FIG. 4, an extruded version of PTFE insulation 20 may further have an added external metal tape 30 to provide mechanical stability, and to prevent unsintered core (inner layer 22 from cracking and also to provide an overall shielding effect.

As described above the PTFE layer 20 is described with relation to extruded PTFE. However, as shown in FIG. 5, the skin curing concept may be applied to a PTFE insulation 20 in tape form PTFE as well, in order to achieve high velocity propagation.

Figure 5:
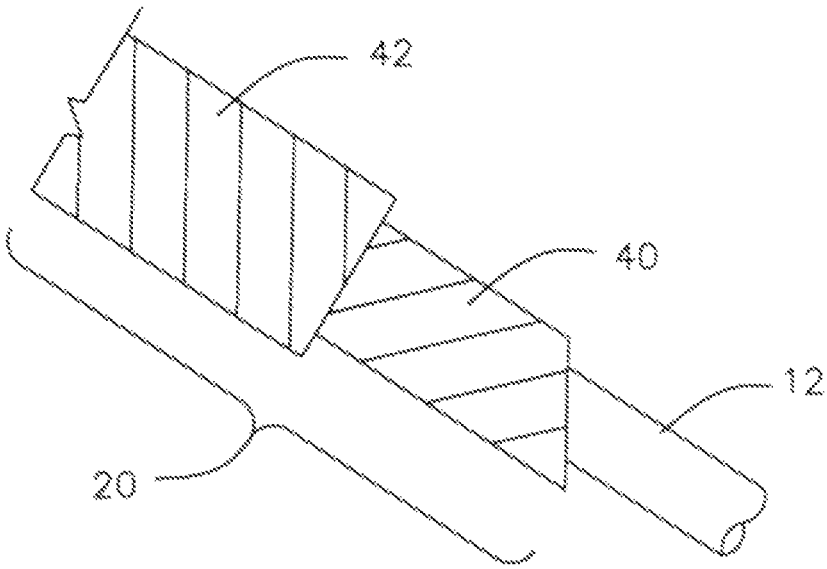
FIG. 5 shows a conductor with a dual tape layer insulation according to another embodiment of the present invention.

For example, as shown in FIG. 5, a first taped layer 40 of raw PTFE and a second tape layer of sintered/cured PTFE 42. Outer tape layer 42 may be applied as a raw PTFE that is subsequently cured (by above described methods) or it may be applied as a wrapping of pre-cured PTFE tape. In such a tape layer construction the use of raw versus pre-cured outer layer 42 may be selected based on the desired adhesion with inner un-cured layer 40, with uncured PTFE adhering better.

Figure 6:
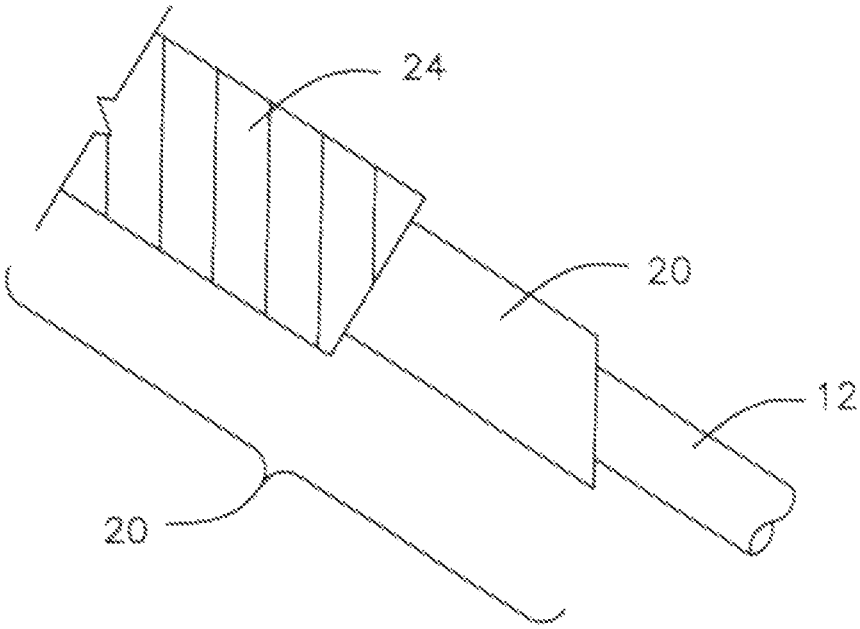
FIG. 6 shows a conductor with a dual layer, skin cured dielectric insulation according to another embodiment of the present invention.

In another arrangement, as shown in FIG. 6, the inner layer 22 of PTFE insulation may be extruded onto conductor 12 with outer skin layer 24 being applied as a wrap then cured.

Figure 7:
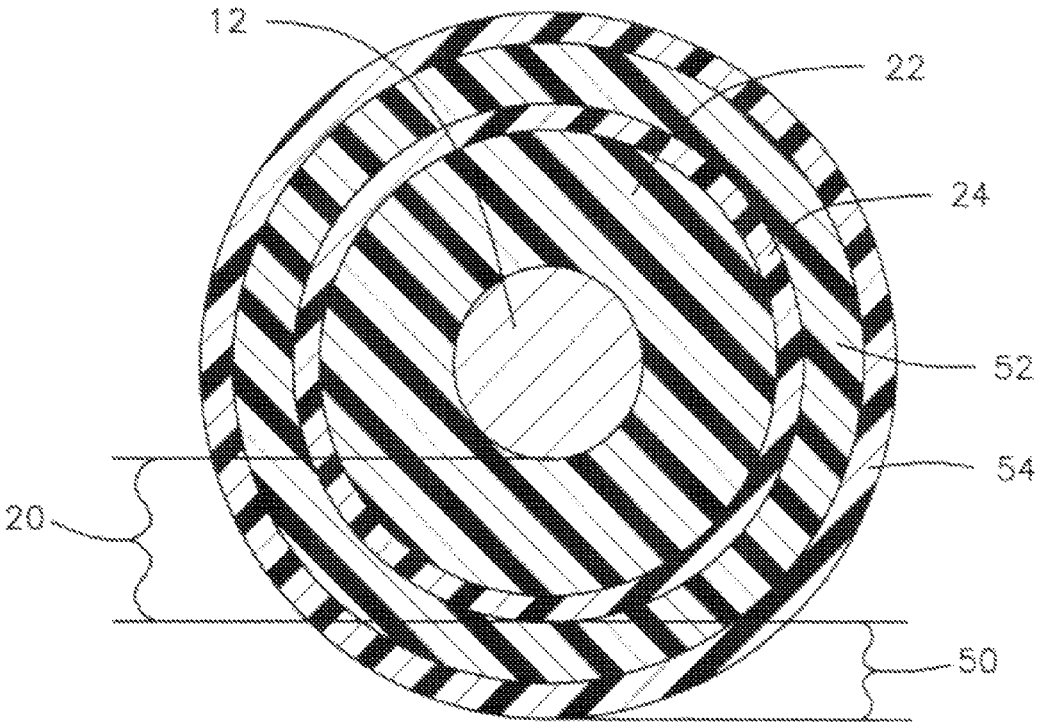
FIG. 7 shows a conductor with two iterations of dual layer, skin cured PTFE dielectric insulation according to another embodiment of the present invention.

In another arrangement shown in FIG. 7, skin cured insulation may be applied in multiple iterations. For example a conductor 12 may be coated in a first-two layer PTFE insulation 20 (having inner and outer layers 22 and 24) as well as a second insulation 50, also having an inner layer 52 of uncured PTFE and an outer layer of cured/sintered PTFE 54. Such an arrangement can likewise be applied to multiple iterations of tape layers as well (not shown). Such an arrangement, may help to improve the handling, especially the stripping process, and give more options for cable 10 construction.

Thus, according to the above examples the insulation 20 having a inner layer 22 of uncured PTFE and a cured outer layer 24 of PTFE improves the abrasion resistance, fibrous disintegration resistance, and pin-through resistance, possible increased dimensional stability, all while achieving a given dielectric constant (lower than fully cured PTFE) with less expansion.

It is noted that although outer skin layer 24 has been described as either a partial curing of an inner layer of uncured PTFE or an applied cured tape layer of PTFE, the embodiments described above may utilize an outer layer 24 using other non-PTFE insulation. For example, outer layer 24, since it is used primarily for physical/mechanical properties, other materials may be used paying less attention to their dielectric properties, especially in view of the fact that outer skin layer 24 is relatively small compared to the total insulation layer 20 thickness.

For example, outer skin layer 24, in arrangements where it is applied separately from inner layer 22, may be selected from any one of Polyimide, Polyamide-imide, Polyamide, expoxy solution or monomer, ETFE (Ethylene tetrafluoroethylene), FEP (fluoroethylene polymer), PFA (Perfluoroalkoxy) and MFA (MetafluoroAlkoxy).

Although the above described embodiments have been described in relation to the Figures, many other variations and modifications and other uses will become apparent to those skilled in the art. It is preferred, therefore, that the present application be limited not by the specific disclosure herein, but only by the appended claims.

What is claimed is:

1. A wire, said wire comprising:

a conductor; and an insulation made from PTFE surrounding said conductor, wherein said insulation is made from a single extruded PTFE coating that includes a first conductor coating insulation layer of cured PTFE surrounding said conductor, a second layer of uncured PTFE surrounding said first conductor coating insulation layer, and an outer layer of cured PTFE, surrounding said first and second layers, wherein each of said first conductor coating insulation layer of cured PTFE, said second layer of uncured PTFE, and said outer layer of cured PTFE are all portions of said single extruded PTFE coating, and wherein said outer layer of cured PTFE is formed by partially curing an outer portion of said second layer of uncured PTFE.

2. The wire as claimed in claim 1, wherein said outer layer is substantially between 0. 01 mils in thickness and 20 mils in thickness.

3. The wire as claimed in claim 2, wherein said outer layer is substantial between 0. 05 mils in thickness and 5 mils in thickness.

4. The wire as claimed in claim 1, wherein said outer layer of cured PTFE is formed by any one of radiant or convection oven, IR oven, LASER curing and a contact. heating source.

5. The wire as claimed in claim 1, wherein said first conductor coating insulation layer is formed by partially curing an inner portion of said second layer of uncured PTFE.

6. The wire as claimed in claim 1, wherein said first conductor coating insulation layer is formed by an induction heater directly heating the conductor.

7. The wire as claimed in claim 1, further comprising a metal tape applied over the insulation.

8. The wire as claimed in claim 1, wherein said second layer of uncured PTFE is applied as a tape and wherein said outer layer of cured PTFE is applied as a tape.

9. The wire as claimed in claim 8, wherein said outer layer of cured PTFE, applied as a tape, is cured after being applied over said second layer.

10. The wire as claimed in claim 1, wherein said second layer of uncured PTFE is applied by extrusion and wherein said outer layer of insulation is applied as a tape.

11. The wire as claimed in claim 10, wherein said outer layer of cured PTFE, applied as a tape, is cured after being applied over said second layer.

12. The wire as claimed in claim 1, wherein said wire further comprises a second insulation, applied over said insulation, said second insulation having an inner uncured layer and an outer cured layer.

13. The wire as claimed in claim 12, wherein the outer layer of cured PTFE is physically in direct contact with said second layer of uncured PTFE.

14. The wire as claimed in claim 12, wherein the insulation is physically in direct contact with the conductor.

15. The wire as claimed in claim 1, wherein the outer layer of cured PTFE is physically in direct contact with the second layer of uncured PTFE.

16. The wire as claimed in claim 1, wherein the insulation is only from PTFE-based layers.

17. The wire as claimed in claim 1, wherein the insulation is physically in direct contact with the conductor.

18. A wire, said wire comprising:

a conductor; and an insulation only made from PTFE-based layers, surrounding said conductor, wherein said insulation is made from a single extruded PTFE coating that includes a layer of uncured PTFE surrounding said conductor, and an outer layer of cured PTFE, surrounding said layer of uncured PTFE, wherein each of said layer of uncured PTFE and said outer layer of cured PUT are all portions of said single extruded PTFE coating, wherein said outer layer of cured PTFE is formed by partially curing an outer portion of said layer of uncured PTFE.

19. A wire, said wire comprising:

a conductor; and an insulation made from PTFE surrounding said conductor, wherein said insulation includes a first conductor coating insulation layer of cured PTFE surrounding said conductor, a second layer of uncured PTFE surrounding said first conductor coating insulation layer, and an outer layer of cured PTFE, surrounding said first and second layers, wherein said first conductor coating layer of cured PTFE is formed by partially curing an inner portion of said second layer of uncured PTFE.

* * * * *

UNITED STATES PATENT AND TRADEMARK OFFICE

CERTIFICATE OF CORRECTION

PATENT NO. : 8,884,163 B2
APPLICATION NO. : 12/434817
DATED : November 11, 2014
INVENTOR(S) : Chu et al.

It is certified that error appears in the above-identified patent and that said Letters Patent is hereby corrected as shown below:

In the Claims,

Column 6, Claim 18, Line 31: The word "PUT" between the words "cured" and "are" should read "PTFE"

Signed and Sealed this
Seventeenth Day of February, 2015

Michelle K. Lee

Michelle K. Lee
*Deputy Director of the United States Patent and Trademark Office*